US006322199B1

(12) United States Patent
Shibata

(10) Patent No.: US 6,322,199 B1
(45) Date of Patent: Nov. 27, 2001

(54) DIRECT ELECTROSTATIC PRINTING APPARATUS WITH ELECTRODE FOR IMPROVED IMAGE GRADATION CONTROL

(75) Inventor: Yoshifumi Shibata, Toyokawa (JP)

(73) Assignees: Minolta Co., Ltd., Osaka (JP); Array Printers AB, Vastra Frolunda (SE)

( * ) Notice: Subject to any disclaimer, the term of this patent is extended or adjusted under 35 U.S.C. 154(b) by 0 days.

(21) Appl. No.: 09/377,435

(22) Filed: Aug. 19, 1999

(30) Foreign Application Priority Data

Aug. 19, 1998 (JP) ..... 10-232755

(51) Int. Cl.[7] ..... B41J 2/06
(52) U.S. Cl. ..... 347/55
(58) Field of Search ..... 347/15, 20, 54, 347/55; 358/298

(56) References Cited

U.S. PATENT DOCUMENTS 5,477,250 12/1995 Larson ..... 347/55
5,708,464 * 1/1998 Desie ..... 347/55
6,011,944 * 1/2000 Nilsson ..... 347/55
6,012,801 * 1/2000 Nilsson ..... 347/55
6,123,418 * 9/2000 Wakahara et al. ..... 347/55

* cited by examiner

*Primary Examiner*—John Barlow
*Assistant Examiner*—Robert D Loper, Jr.
(74) *Attorney, Agent, or Firm*—Morrison & Foerster LLP

(57) ABSTRACT

A direct recording apparatus comprises a recording roller for retaining charged toner particles, a back electrode provided as opposed to the recording roller to electrostatically attract the toner particles, a PC board disposed between the recording roller and the back electrode, and provided with apertures having a diameter through which the toner particles can pass, a first electrode disposed near the aperture in the PC board, to which a predetermined voltage is applied in order to more strongly attract the toner particles retained on the recording roller toward the back electrode, and a second electrode disposed near the aperture and on the side of the back electrode with respect to the first electrode in the PC board, to which a predetermined voltage is applied so that a group of toner particles passing through the aperture converges, wherein gradation of an image to be recorded are controlled by adjusting the application time of a pulse voltage to be applied to the first electrode depending on a base voltage to be applied to the second electrode. With this configuration, proper gradation control can be attained depending on the potential of the second electrode.

4 Claims, 6 Drawing Sheets

| IMAGE DENSITY ID | APPLICATION TIME t OF PULSE VOLTAGE TO FIRST ELECTRODE |
|---|---|
| 0 | 0 μsec |
| 0.2 | 40 |
| 0.4 | 50 |
| 0.6 | 60 |
| 0.8 | 80 |
| 1.0 | 100 |
| 1.2 | 120 |
| 1.4 | 150 |

| IMAGE DENSITY ID | APPLICATION TIME t OF PULSE VOLTAGE TO FIRST ELECTRODE |
|---|---|
| 0 | 0 μsec |
| 0.2 | 10 |
| 0.4 | 30 |
| 0.6 | 50 |
| 0.8 | 60 |
| 1.0 | 70 |
| 1.2 | 80 |
| 1.4 | 90 |

Fig.10

| IMAGE DENSITY ID | APPLICATION TIME t OF PULSE VOLTAGE TO FIRST ELECTRODE |
|---|---|
| 0 | 0 μsec |
| 0.2 | 20 |
| 0.4 | 30 |
| 0.6 | 190 |
| 0.8 | 160 |
| 1.0 | 130 |
| 1.2 | 100 |
| 1.4 | 80 |

Fig.11

| IMAGE DENSITY ID | APPLICATION TIME t OF PULSE VOLTAGE TO FIRST ELECTRODE |
|---|---|
| 0 | 0 μsec |
| 0.2 | 180 |
| 0.4 | 150 |
| 0.6 | 120 |
| 0.8 | 100 |
| 1.0 | 80 |
| 1.2 | 70 |
| 1.4 | 60 |

DIRECT ELECTROSTATIC PRINTING APPARATUS WITH ELECTRODE FOR IMPROVED IMAGE GRADATION CONTROL

RELATED APPLICATION

This application is based on Japanese Patent Application No.10-232755, the content of which is incorporated herein by reference.

BACKGROUND OF THE INVENTION

1. [Field of the Invention]

The present invention relates to an apparatus for recording images on a recording sheet, such as paper, by allowing recording particles to jump and directly attach to the recording sheet.

2. [Description of the Related Art]

U.S. Pat. No. 5,477,250, issued on Dec. 19, 1995, discloses a recording apparatus. This recording apparatus comprises a cylindrical toner retaining member, which is rotatable, for retaining charged toner particles on its outer peripheral surface, and a back electrode spaced from the toner retaining member. The back electrode is electrically connected to a power source so that an electric field is formed to attract the charged toner particles on the toner retaining member toward the back electrode. An insulating plate provided with a plurality of apertures, through which the toner particles can pass, is disposed between the toner retaining member and the back electrode. In addition, the insulating plate is provided with a ring-shaped electrode surrounding each of the apertures.

In the above-mentioned recording apparatus, when a signal corresponding to image data is applied to the electrode, the toner particles existing at a position on the toner retaining member, where is opposed to the electrode, jump into the corresponding aperture. After passing through this aperture, the toner particles attach to a recording sheet, and an image corresponding to the image data is recorded on the recording sheet.

In the above-mentioned recording apparatus, the toner particles disperse while jumping, and attach to the recording sheet, thereby forming a dot that is blurred in outline and has a low density. A recorded image obtained in this way is therefore blurred in outline and lacks sharpness.

In order to solve this problem, a method is available wherein a guard electrode surrounding the aperture is provided on the back electrode side of the insulating plate with respect to the ring-shaped electrode, and a voltage having the same polarity as that of the charged toner particles is applied to this guard electrode so that the group of the toner particles jumping inside the aperture is biased by electric repulsion force to converge inwardly in the radial direction. With this method, a dot that is sharp in outline and has a high density can be formed, and an image having high definition can be obtained.

In the case of the above-mentioned recording apparatus without the guard electrode, the density of an image to be recorded is apt to rise as the application time of the signal to be applied to the ring-shaped electrode is prolonged. Therefore, in the case of carrying out gradation representation by using this recording apparatus, the application time of the signal to be applied to the ring-shaped electrode is generally prolonged to raise the image density.

However, in the recording apparatus with the guard electrode, it was found that the image density rises once as the application time of the signal to be applied to the ring-shaped electrode is prolonged, but lowers after the application time goes beyond a certain time, depending on the voltage potential applied to the guard electrode, in some cases. In these cases, it is impossible to perform gradation control by using the method of simply prolonging the application time of the signal to be applied to the ring-shaped electrode to raise the image density.

SUMMARY OF THE INVENTION

Accordingly, one feature of the present invention is to provide a recording apparatus capable of performing proper gradation control depending on the voltage potential to be applied to the guard electrode thereof.

To provide this feature, among other features of the present invention, the direct recording apparatus of the present invention includes:

- a retaining member for retaining charged recording particles;
- a back electrode opposed to the retaining member to electrostatically attract the recording particles;
- a PC board disposed between the retaining member and the back electrode so as to form a passage with the back electrode, through which a recording sheet passes, and provided with apertures having a diameter through which the toner particles can pass;
- a first electrode disposed near each of the apertures in the PC board, to which a first voltage is applied in order to more strongly attract the toner particles retained on the retaining member toward the back electrode; and
- a second electrode disposed near each of the apertures and nearer the back electrode side than the first electrode in the PC board, to which a second voltage is applied so that a group of toner particles passing through the aperture converges;
- wherein gradation of an image to be recorded are controlled by adjusting the application time of the first voltage to be applied to the first electrode depending on the second voltage to be applied to the second electrode.

In accordance with this direct recording apparatus of the present invention, the gradations of the image to be recorded are controlled by adjusting the application time of the first voltage to be applied to the first electrode depending on the second voltage applied to the second electrode. Therefore, gradation representation can be carried out properly, even when the characteristic in the relationship between the image density and the application time of the voltage to be applied to the first electrode changes depending on the potential of the second electrode.

In the direct recording apparatus of the present invention, the second voltage to be applied to the second electrode may be set so that the density of the image to be formed rises monotonically, or rises monotonically once and then becomes substantially constant as the application time of the first voltage is prolonged. In this case, the second voltage potential should only be 0 (zero) or a potential having the polarity opposite to the polarity of the charged toner particles.

In accordance with this direct recording apparatus of the present invention, the second voltage to be applied to the second electrode is set so that the density of the image to be formed rises monotonically, or rises monotonically once and then becomes substantially constant as the application time of the first voltage is prolonged. Therefore, the application time of the voltage to be applied to the first electrode should only be prolonged in the case of desiring to raise the image density, just as the conventional recording apparatus having only the first electrode. As a result, gradation control can be simplified.

Furthermore, in the direct recording apparatus of the present invention, the gradation of the image to be recorded may be controlled by setting the second voltage to be applied to the second electrode so that the density of the image to be formed rises once and then lowers gently as the application time of the first voltage is prolonged, and by using the first voltage application time period of an area wherein the image density lowers gently.

In accordance with this direct recording apparatus of the present invention, the gradation of the image to be recorded is controlled by setting the second voltage to be applied to the second electrode so that the density of the image to be formed rises once and then lowers gently as the application time of the first voltage is prolonged, and by using the first voltage application time period of the area wherein the image density lowers gently. In this case, since the gradation control is carried out using the time period of the area wherein the relationship between the image density and the voltage application time changes gently, the gradation can be produced more easily, and stable gradation control can be carried out accurately and easily.

BRIEF DESCRIPTION OF THE DRAWINGS

The present invention will be further described with reference to the accompanying drawings wherein like reference reference numerals refer to like parts in the several views, and wherein:

FIG. 10 is a control table in the case when gradation control is carried out by using areas B and C in the graph of FIG. 8; and FIG. 11 is a control table in the case when gradation control is carried out by using only an area B in the graph of FIG. 8.

DETAILED DESCRIPTION OF PREFERRED EMBODIMENTS

Figure 1:
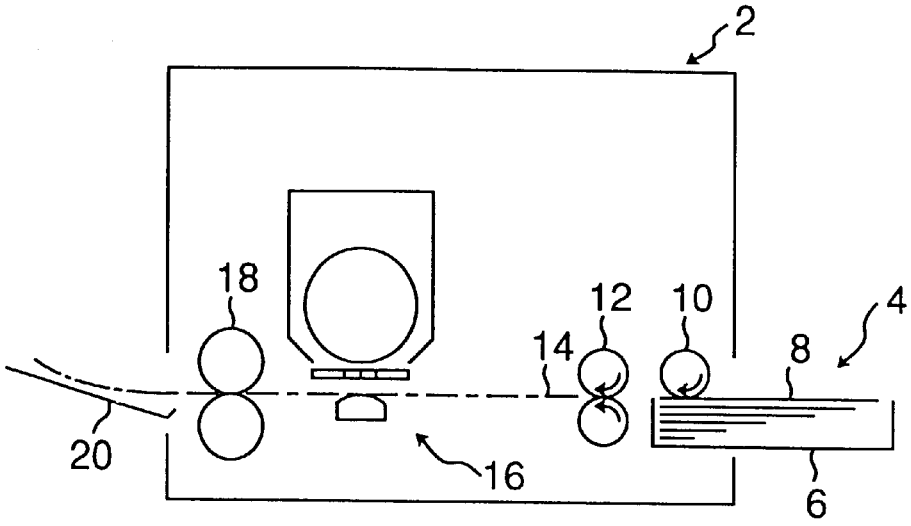
FIG. 1 is a schematic sectional view showing a direct recording apparatus in accordance with the present invention.

Referring to FIG. 1, a reference numeral 2 designates the whole structure of a direct recording apparatus in accordance with the present invention. The recording apparatus 2 has a sheet supply station, the whole structure of which is designated by a reference numeral 4. The sheet supply station 4 is removably provided with a cassette 6, in which sheets 8 of paper or the like are stacked and accommodated. A sheet supply roller 10 is disposed above the cassette 6, and rotates while making contact with the uppermost sheet 8 to feed this sheet 8 into the recording apparatus 2. Near the sheet supply roller 10, a pair of timing rollers 12 is disposed to supply the sheet 8 fed from the cassette 6 along a sheet passage 14 indicated by a chain line to a recording station (the whole structure is designated by a reference numeral 16) in which an image made of recording particles is formed on the sheet 8. Furthermore, the recording apparatus 2 has a fixing station 18 for permanently fixing the image formed of the recording particles, and a final stack station 20 for accommodating the sheet 8 on which the image formed of the recording particles is fixed.

Figure 2:
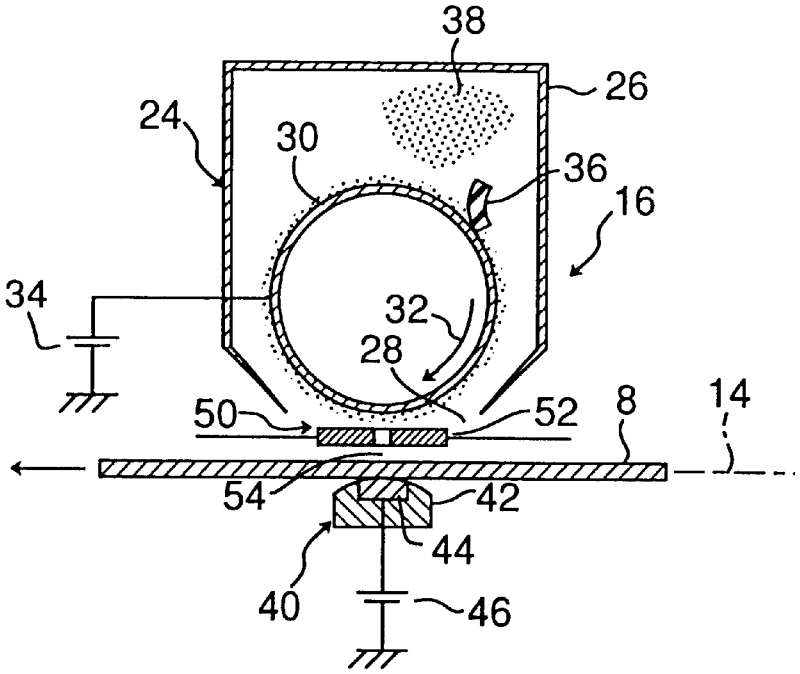
FIG. 2 is a schematic sectional view showing a recording station.

Referring to FIG. 2, the recording station 16 has a recording particle supply portion, the whole structure of which is designated by a reference numeral 24, above the sheet passage 14. This recording particle supply portion 24 has a container 26. This container 26 is provided with an opening 28 opposed to the sheet passage 14. Near the opening 28, a recording roller (a retaining member) 30 is supported rotatably in the direction indicated by an arrow 32. The recording roller 30 is made of a conductive material and electrically grounded via a DC power source 34. A blade 36 which is formed of a plate preferably made of rubber or stainless steel is disposed so as to make contact with the recording roller 30. The recording roller 30 may be directly grounded, instead of being grounded via the DC power source 34.

The container 26 accommodates the recording particles, i.e., toner particles 38. The toner particles 38 are supplied to the outer peripheral surface of the recording roller 30 by a supply means, i.e., a supply roller (not shown), provided inside the container 26, and transferred in accordance with the rotation of the recording roller 30. Subsequently, the toner particles 38 retained on the recording roller 30 are fed to an area where the recording roller 30 makes contact with the blade 36. In this area, the toner particles 38 are charged to have a predetermined polarity by frictional contact with the blade 36. The present embodiment uses the toner particles 38 that are charged negatively. As a result, the outer peripheral surface of the recording roller 30 having passed the area where the recording roller 30 makes contact with the blade 36 retains a thin layer of the toner particles 38 charged negatively. In addition, a positive voltage is supplied from the power source 34 to the recording roller 30 as shown in FIG. 2 so that the negatively charged toner particles 38 are electrically attracted by the recording roller 30. In the case when the recording roller 30 is grounded directly, the toner particles 38 are retained on the record roller 30 by image force.

An electrode device, the whole structure of which is designated by a reference numeral 40, is disposed under the recording particle supply portion 24 beyond the sheet passage 14. This electrode device 40 has a support 42 made of an insulating material, and a back electrode 44 made of a conductive material. The back electrode 44 is connected to a power source 46, from which a voltage having a predetermined polarity (the positive polarity in the present embodiment) is supplied thereto, whereby the negatively charged toner particles on the recording roller 30 are electrically attracted by the back electrode 44. The level of the voltage to be applied from the power source 46 to the back electrode 44 is set so that the electric field formed between the back electrode 44 and the recording roller 30 by the application of the voltage is not strong enough to allow the toner particles 38 to jump.

Figure 3:
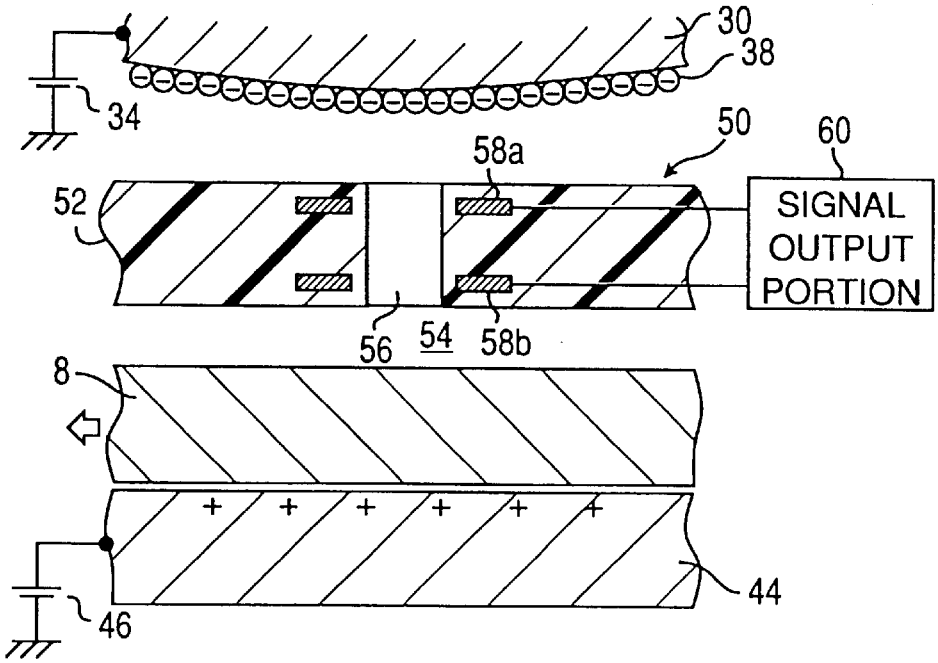
FIG. 3 is a partially enlarged sectional view showing a PC board, a recording roller and a back electrode at the time when a thin layer of toner particles is retained on the recording roller.

A PC board, the whole structure of which is designated by a reference numeral 50, is secured between the recording particle supply portion 24 and the electrode device 40 and above the sheet passage 14. The PC board 50 should preferably be formed of a flexible printed circuit board 52 having a thickness of about 100 μm to about 200 μm. As shown in FIGS. 2 and 3, a portion of the PC board 50, positioned at a recording area 54 wherein the recording roller 30 is opposed to the back electrode 44, is provided with a plurality of apertures 56 having an inner diameter of about 25 μm to about 200 μm, substantially larger than the average grain diameter (about 5 μm to about 15 μm) of the toner particles 38. These apertures 56 are disposed evenly spaced at predetermined intervals in the direction perpendicular to the sheet feeding direction.

As shown in FIG. 3, the flexible printed circuit board 52 is provided with a doughnut-shaped first electrode 58*a* and a doughnut-shaped second electrode 58*b* around each aperture 56. The first electrode 58*a* is disposed near the surface of the flexible printed circuit board 52, opposed to the recording roller 30. The second electrode 58*b* is inside the flexible printed circuit board 52 and disposed on the side of the back electrode 44 with respect to the first electrode 58*a*. These first and second electrodes 58*a* and 58*b* are connected to an image signal output portion 60, from which predetermined signals are applied to the electrodes 58*a* and 58*b*, respectively.

The second electrode 58*b* is not necessarily embedded inside the flexible printed circuit board 52, but may be formed so as to be exposed on the lower surface of the flexible printed circuit board 52.

Next, the operation of the recording apparatus 2 will be described below. At the recording particle supply portion 24, the recording roller 30 rotates in the direction indicated by the arrow 32 as shown in FIG. 2. The toner particles 38 are supplied to the recording roller 30 and fed to the area wherein the blade 36 and the recording roller 30 make contact with each other. At this area, the toner particles 38 are negatively charged by the friction with the blade 36. Consequently, the outer peripheral portion of the recording roller 30, having passed through the above-mentioned contact area, retains the thin layer of the charged toner particles 38 as shown in FIG. 3.

At the time of non-recording, a base voltage of, for example, about −100 V is applied to both the first electrode 58*a* and the second electrode 58*b*. For this reason, the negatively charged toner particles 38 on the recording roller 30 are electrically repelled by the first electrode 58*a* and the second electrode 58*b*, and remain retained stably on the recording roller 30, without jumping toward the aperture 56.

Figure 4:
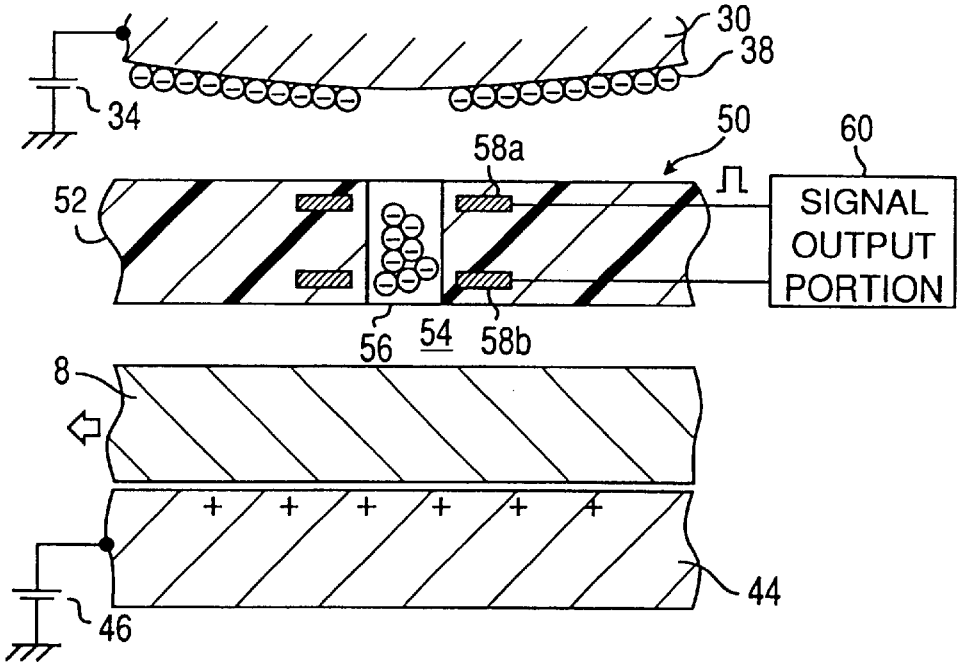
FIG. 4 is a partially enlarged sectional view showing the PC board, the recording roller and the back electrode at the time when the toner particles jump from the recording roller toward a aperture in the PC board.
Figure 5:
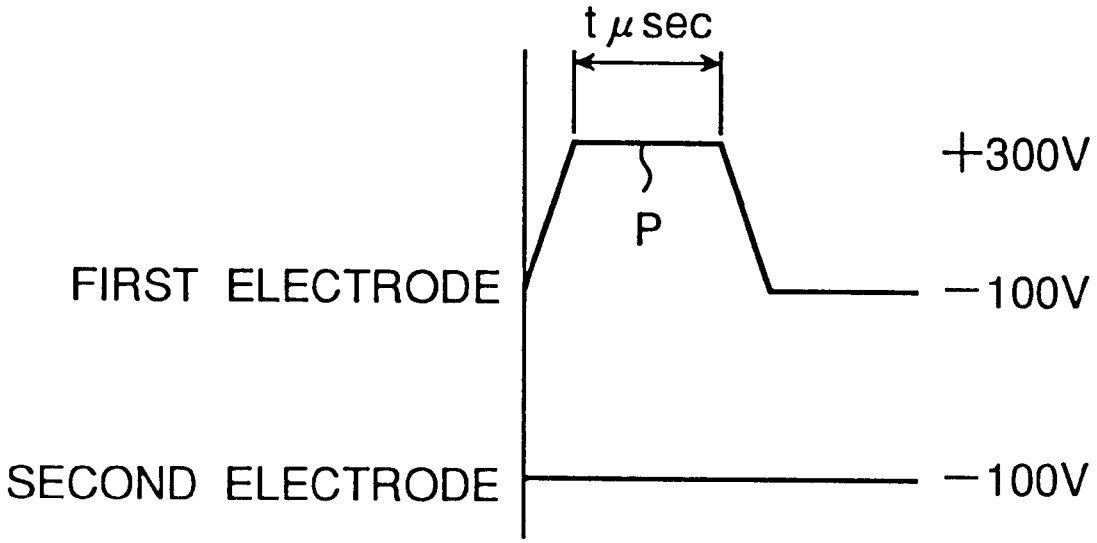
FIG. 5 is a waveform chart indicating a pulse voltage for toner jumping to be applied to a first electrode and abase voltage applied to a second electrode.

At the time of recording, the signal output portion 60 outputs a signal to the first electrode 58*a* in accordance with an image to be recorded. In other words, as shown in FIG. 5, a positive pulse voltage P of, for example, +300 V is applied to the first electrode 58*a*. On the other hand, a constant base voltage of −100 V remains applied to the second electrode 58*b* from the signal output portion 60. Therefore, the negatively charged toner particles 38 retained on the recording roller 30 are electrically attracted more strongly at the position opposed to the first electrode 58*a* to which the pulse voltage P has been applied. In addition, the attraction force by the back electrode 44 is further exerted to the toner particles 38 at the same position. As a result, the toner particles 38 jump toward the corresponding aperture 56 as shown in FIG. 4.

When the jumping toner particles 38 are passing through the aperture 56, the voltage applied to the first electrode 58*a* is changed by the signal output portion 60 to the base voltage (−100 V) used for the non-recording time. As a result, the negatively charged jumping toner particles 38 are biased inwardly in the radial direction from the surrounding by electric repulsion force, and the toner particles 38 converge. The group of the toner particles having converged passes through the aperture 56 and attaches to the sheet 8 fed from the sheet supply station 4 to the recording area 54, thereby forming a dot. The dot formed in this way by the toner particles 38 having converged can have a clear outline and high density on the sheet 8. When the voltage applied to the first electrode 58*a* is changed from the pulse voltage P to the base voltage, the toner particles 38 stop jumping from the recording roller 30.

The sheet 8 to which the toner particles 38 have attached is fed to the fixing station 18. At this station, the toner particles 38 are heated and permanently fixed to the sheet 8. In the end, the sheet 8 is ejected on the stack station 20.

Figures 6, 7:
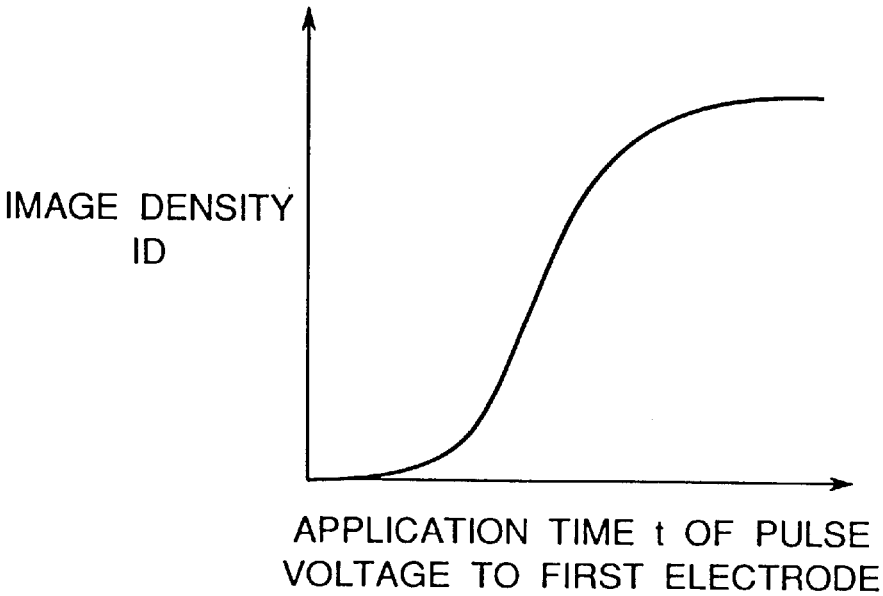
FIG. 6 is a graph showing a relationship between image density and the application time of the pulse voltage to be applied to the first electrode.
FIG. 7 is a gradation control table for the recording apparatus having the characteristic shown in FIG. 6.

Next, a method wherein gradation of an image to be recorded are controlled by adjusting the amount of the toner particles 38 jumping from the recording roller 30 will be described below. Generally, in the case of a recording apparatus not provided with the second electrode 58*b*, the density of the image to be recorded rises as application time t (see FIG. 5) of the pulse voltage P for toner jumping to be applied to the first electrode 58*a* is prolonged. More specifically, as the application time t of the pulse voltage to be applied to the first electrode 58*a* is prolonged, the image density ID rises monotonously, or rises monotonously once and then becomes saturated at a substantially constant level, as shown in the graph of FIG. 6. In this case, the gradation of the image to be recorded can be controlled by gradually prolonging the pulse voltage application time t as shown in the control table of FIG. 7.

Figures 8, 9:
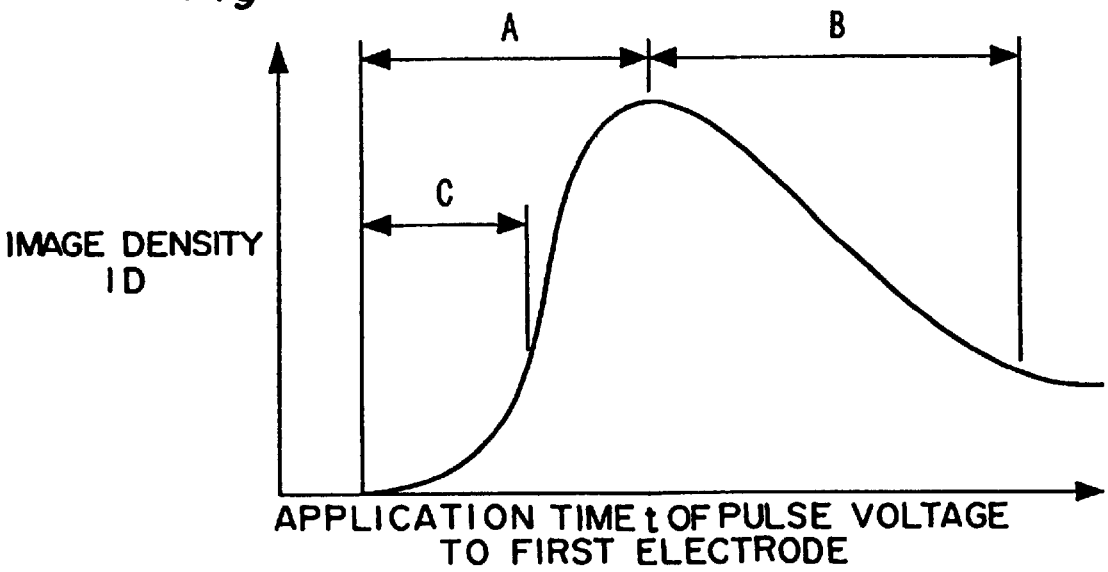
FIG. 8 is a graph showing another relationship between image density and the application time of the pulse voltage to be applied to the first electrode.
FIG. 9 is a control table in the case when gradation control is carried out by using only an area A in the graph of FIG. 8.

However, in the case of the recording apparatus 2 provided with the second electrode 58*b* in accordance with the present embodiment, the relationship between the image density ID and the application time t of the pulse voltage to be applied to the first electrode 58*a* changes depending on the voltage potential applied to the second electrode 58*b*. More specifically, in the case when the base voltage (−100 V) having the same polarity as that of the charged toner particles 38 is applied to the second electrode 58*b* as described above, the relationship between the pulse voltage application time t and the image density ID is obtained as shown in the graph of FIG. 8. In other words, the image density ID abruptly rises once (area A) with the passage of the pulse voltage application time t, and then lowers after a certain time (area B). The inclination of the curve of the image density ID in the area B is gentler than that in the area A. Therefore, the method wherein the pulse voltage application time t is simply prolonged to raise the image density ID, just as in the case of the above-mentioned recording apparatus having only the first electrode 58*a*, is not applicable to control gradation representation under the conditions having this kind of relationship. Furthermore, if an attempt is made to represent all the gradation by using the time period of the area A wherein the inclination of the density curve is steep, the application time t of the pulse voltage P to be applied to the first electrode 58*a* must be controlled minutely as indicated in FIG. 9. It is technologically difficult to carry out stable gradation representation by using this kind of control.

For this reason, the gradation representation for the above-mentioned recording apparatus 2 should preferably be carried out by using the time period of the area B wherein the curve of the image density ID with respect to the pulse voltage application time t is relatively gentle, together with the time period of the area A. FIGS. 10 and 11 indicate control tables to be used in this case. In the control table indicated in FIG. 10, the time period of the start area C in the area A, wherein the inclination of the density curve is relatively gentle, is used to represent low density levels (image density ID: 0 to 0.4). Furthermore, the area B, wherein the inclination of the density curve after its peak becomes gentle, is used to represent middle to high density levels (image density ID: 0.6 to 1.4). The pulse voltage application time t is adjusted so as to be shortened as the density rises from the middle density level to the high density level. In addition, the control table indicated in FIG. 11 is used to control the image density ID by using only the time period of the area B after the peak of the density curve. In this case, the pulse voltage application time t is adjusted so as to be shortened as the density rises from the low density level to the high density level. By using the time period wherein the inclination of the curve of the image density ID after its peak is gentle in this way, the stepwise adjustment width of the pulse voltage application time t can be increased. As a result, it is possible to carry out stable gradation representation accurately and easily.

Even in the case of the above-mentioned recording apparatus 2, by changing the setting of the base voltage applied to the second electrode 58*b*, the image density ID can rise monotonously, or rise monotonously once and then become substantially constant as the application time t (see FIG. 5) of the pulse voltage P for toner jumping to be applied to the first electrode 58*a* is prolonged as shown in FIG. 6. More specifically, in the case when the base voltage potential to be applied to the second electrode 58*b* is set to O(zero) or a potential (positive, for example, +200 V) having the polarity opposite to the polarity (negative) of the charged toner particles, the relationship between the image density ID and the application time t of the pulse voltage to be applied to the first electrode 58*a* is represented by a curve having no peak as shown in FIG. 6. Therefore, just as in the case of the conventional recording apparatus having only the first electrode 58*a*, the above-mentioned recording apparatus 2 can carry out gradation control in accordance with the control table of, for example, FIG. 7.

By setting the potential of the second electrode 58*b* to 0 (zero) or a positive value, the converging effect on the negatively charged toner particles 38 is weakened, but not lost completely.

Furthermore, in the case when positively charged toner particles are used, by setting the base voltage potential applied to the second electrode 58*b* to 0 (zero) or a negative value, the relationship between the image density ID and the application time t of the pulse voltage to be applied to the first electrode 58*a* is also represented by such a curve as that shown in FIG. 6.

As described above, in the recording apparatus 2 of the present embodiment, the gradation of the image to be recorded are controlled by adjusting the application time of the pulse voltage (the first voltage) to be applied to the first electrode 58*a* depending on the potential of the base voltage (the second voltage) to be applied to the second electrode 58*b*. Therefore, gradation representation can be carried out properly, even when the characteristic in the relationship between the image density ID and the application time t of the voltage to be applied to the first electrode 58*a* changes depending on the potential of the second electrode 58*b*.

Furthermore, in the case when the base voltage to be applied to the second electrode 58*b* is set so that the image density ID rises monotonously, or rises monotonously once and then become substantially constant as the pulse voltage application time t is prolonged, the application time t of the pulse voltage to be applied to the first electrode 58*a* should only be prolonged to raise the image density ID, just as in the case of the conventional recording apparatus having only the first electrode 58*a*. As a result, the gradation control can be simplified.

Moreover, in the case when the base voltage to be applied to the second electrode 58*b* is set so that the image density ID rises monotonously once and then lowers gently as the pulse voltage application time t is prolonged, and when the gradation of an image to be recorded is controlled by using the pulse voltage application time period of the area B wherein the image density ID lowers gently, the gradation control is carried out in the area B wherein the relationship between the image density ID and the pulse voltage application time t changes gently. For this reason, gradation can be represented more easily, and stable gradation control can be carried out accurately and easily.

It is to be noted that the recording particle supply portion is not limited to the above-mentioned type. Any types of developing devices available for electrophotographic image forming apparatuses can be used instead of the recording particle supply portion.

Although the present invention has been fully described by way of examples with reference to the accompanying drawings, it is to be noted that various changes and modifications will be apparent to those skilled in the art. Therefore, unless otherwise such changes and modifications depart from the scope of the present, they should be construed as being included thereto.

What is claimed is:

1. A direct recording apparatus comprising:

a retaining member for retaining charged recording particles;

a back electrode opposing said retaining member to electrostatically attract said recording particles;

a PC board disposed between said retaining member and said back electrode so as to form a passage with said back electrode through which a recording sheet passes, and provided with apertures having diameters through which said recording particles can pass;

a first electrode disposed near each of said apertures in said PC board, to which a first voltage is applied in order to more strongly attract said recording particles retained on said retaining member toward said back electrode; and a second electrode disposed near each of said apertures and nearer said back electrode than said first electrode in said PC board, to which a second voltage is applied so that a group of recording particles passing through said aperture converges;

wherein gradation of an image to be recorded is controlled by adjusting an application time of said first voltage to be applied to said first electrode, said application time depending on the polarity of said second voltage to be applied to said second electrode.

2. A direct recording apparatus in accordance with claim 1, wherein said second voltage to be applied to said second electrode is set so that a density of said image to be formed rises monotonically, or rises monotonically once and then becomes substantially constant as said first voltage application time is continued.

3. A direct recording apparatus in accordance with claim 2, wherein said second voltage is zero or a potential having a polarity opposite to a polarity of said charged recording particles.

4. A direct recording apparatus in accordance with claim 1, wherein the gradation of said image to be recorded is controlled by setting said second voltage to be applied to said second electrode so that a density of said image to be formed rises once and then lowers gently as said first voltage application time is prolonged, and by using said first voltage application time period for an area wherein said image density lowers gently.

* * * * *